US007404555B2

(12) United States Patent
Yonemoto

(10) Patent No.: US 7,404,555 B2
(45) Date of Patent: Jul. 29, 2008

(54) PAPER FEEDER FOR AN IMAGE FORMING APPARATUS

(75) Inventor: Satoru Yonemoto, Sakai (JP)

(73) Assignee: Kyocera Mita Corporation, Osaka (JP)

( * ) Notice: Subject to any disclaimer, the term of this patent is extended or adjusted under 35 U.S.C. 154(b) by 266 days.

(21) Appl. No.: 11/270,315

(22) Filed: Nov. 9, 2005

(65) Prior Publication Data

US 2006/0180980 A1 Aug. 17, 2006

(30) Foreign Application Priority Data

Nov. 9, 2004 (JP) ..... 2004-325090

(51) Int. Cl.
*B65H 1/22* (2006.01)

(52) U.S. Cl. ..... 271/164; 271/145

(58) Field of Classification Search ..... 271/145, 271/162, 164, 171, 163; 399/393; 347/104
See application file for complete search history.

(56) References Cited

U.S. PATENT DOCUMENTS 3,989,236 A * 11/1976 Komori et al. ..... 271/4.1
4,775,138 A * 10/1988 Muller ..... 271/9.07
5,004,219 A * 4/1991 Godlewski ..... 271/116
5,046,715 A * 9/1991 Taniguchi et al. ..... 271/164
5,088,718 A * 2/1992 Stepan et al. ..... 271/161
5,100,123 A * 3/1992 Kagiura et al. ..... 271/164
5,154,408 A * 10/1992 Stepan et al. ..... 271/121
6,595,514 B2 * 7/2003 Takahashi ..... 271/162
6,871,848 B2 * 3/2005 Matsushima et al. ..... 271/171
2007/0182089 A1 * 8/2007 Kawashima et al. ..... 271/164

FOREIGN PATENT DOCUMENTS

JP 63134434 A * 6/1988
JP 2001-287840 10/2001

* cited by examiner

*Primary Examiner*—Patrick Mackey
*Assistant Examiner*—Michael C McCullough
(74) *Attorney, Agent, or Firm*—The Webb Law Firm

(57) ABSTRACT

A tray positioning mechanism S contacts one of a paper feed tray 2 and a main apparatus body as the paper feed tray 2 is attached to a tray receiver 52, to restrict movement in an attaching direction of the paper feed tray 2. The tray positioning mechanism S is attached to the other of the paper feed tray 2 and the main apparatus body. The tray positioning mechanism S includes a fixed member Sf fixed to the other of the paper feed tray 2 and the main apparatus body, and a contact member St having a contact portion Sh. The fixed member Sf and contact member St are relatively movably connected to each other. At least one of the fixed member Sf and the contact member St has a plurality of reaction force receiving surfaces Ss formed continuously for receiving a contact reaction force of the tray positioning mechanism S when the fixed member Sf and the contact member St are in contact with each other. The reaction force receiving surfaces Ss are switchable to an operative state to vary and adjust the position in the tray moving direction of the contact portion Sh. As a result, a paper feeder for an image forming apparatus is provided, which can prevent a deviation of an adjusted position by a simple operation to adjust an optical of an image.

4 Claims, 10 Drawing Sheets

(a)

(b)

(a)

(b)

PAPER FEEDER FOR AN IMAGE FORMING APPARATUS

BACKGROUND OF THE INVENTION

1. Field of the Invention

This invention relates to a paper feeder or an image forming apparatus comprising:

a paper feed tray attachable to a tray receiver of a main apparatus body by moving in a tray moving direction perpendicular to a direction of feeding paper loaded in the feed tray; and a tray positioning mechanism for contacting one of the paper feed tray and the main apparatus body as the paper feed tray is attached to the tray receiver, to restrict movement in an attaching direction of the paper fixed tray, the tray positioning mechanism being attached to the other of the paper feed tray and the main apparatus body;

the tray positioning mechanism having a contact portion for contacting one of the paper feed tray and the main apparatus body, a position of the contact portion being adjustable in the tray moving direction;

2. Prior Art

Such a paper feeder for an image forming apparatus (which may be referred to simply as a paper feeder hereinafter) is used in an image forming apparatus such as a copying machine, printer or facsimile machine for feeding paper one sheet at a time for forming images at an image forming station.

To describe this further, a tray positioning mechanism is allowed to contact one of a paper feed tray and a main apparatus body as the paper feed tray is moved toward a tray receiver along a tray moving direction perpendicular to a direction of feeding paper loaded in the feed tray. The tray positioning mechanism is attached to the other of the paper feed tray and the main apparatus body. This restricts movement in the attaching direction of the paper feed tray is regulated, whereby the paper feed tray is loaded into the tray receiver as positioned in the tray moving direction.

Paper is fed from the paper feed tray loaded into the tray receiver in this way, and transported to the image formation station. However, the loading position of the paper feed tray in the tray receiver is variable in the tray moving direction due to a manufacture error of the tray receiver in the main apparatus body, a manufacture error of the paper feed tray, and so on Consequently, at the image forming station, a paper setting position where the paper from the paper feed tray is placed deviates from an image forming position in a direction extending along the tray moving direction.

Then, the position of a contact portion of the tray positioning mechanism that contacts the main apparatus body or the paper feed tray is made adjustable in the tray moving direction. The position of the contact portion is adjusted along the tray moving direction to adjust the loading position of the paper feed tray to the tray receiver in the tray moving direction. By doing so, what is called optical aids adjustment is effected to adjust the paper setting position to the image forming position in the direction along the tray moving direction.

In such a paper feeder, conventionally, the tray positioning mechanism includes a bent plate-like contact member having a position adjusting plate portion extending in the tray moving direction, and a contact plate-like portion extending in the paper feed direction. The position adjusting plate portion defines a linear slot extending in the tray moving direction. The tray positioning mechanism further includes a bolt-like object passed through the slot and screwed to the paper feed tray or the main apparatus body, to attach the bent plate-like contact member to the paper feed tray or the main apparatus body.

The bolt-like object is loosened to allow the bent plate-like contact member to move along the tray moving direction. The bent plate-like contact member is moved along the tray moving direction, to move the contact portion provided in the contact plate-like portion in the tray moving direction and set the contact portion to a target position. Thereafter the bolt-like object is tightened to the paper feed tray or the main apparatus body, to attach the bent plate-like contact-member to the paper feed tray or the main apparatus body. In this way, the position of the contact portion is varied and adjusted in the tray moving direction, to adjust the optical axis of the image.

In a different conventional construction, the tray positioning mechanism includes a bent plate-like contact member having a position adjusting plate portion extending in the tray moving direction, and a contact plate-like portion extending in the paper feed direction, in which the position adjusting plate portion defines a plurality of bolt receiving bores arranged in the tray moving direction. The tray positioning mechanism further includes a bolt-like object passed through one of the bolt receiving bores and screwed to the paper feed tray or the main apparatus body, to attach the bent plate-like contact member to the paper feed tray or the main apparatus body.

The bolt-like object is removed from the paper feed tray or the main apparatus body, and is passed through a desired one of the bolt receiving bores and tightened to the paper feed tray or the main apparatus body, to attach the bent plate-like contact member to the paper feed tray or the main apparatus body. In this way, the position of the contact portion is varied and adjusted in the tray moving direction, to adjust the optical axis of the image (see Japanese Patent Application "Kokai" No. 2001-287840, for example).

The conventional paper feeders have the following drawbacks in the optical axis adjustment for an image, and improvement has been desired.

In the construction in which the position adjusting plate portion of the bent plate-like contact member defines a linear slot extending in the tray moving direction, and the bolt-like object is passed through the slot and screwed to the paper feed tray or the main apparatus body to attach the bent plate-like contact member to the paper feed tray or the main apparatus body, the bolt-like object is loosened to allow the bent plate-like contact member to move along the tray moving direction without being removed from the paper feed tray or the main apparatus body. This allows the position of the contact portion to be adjusted in the tray moving direction, and the optical axis of an image may be carried out relatively easily.

However, with the bolt-like object passed through an intermediate position with respect to the tray moving direction of the slot, and screwed to the paper feed tray or main apparatus body, when the tray positioning mechanism contacts one of the paper feed tray and the main apparatus body, a force applied to the tray positioning mechanism counter to the tray loading direction (which may be called contact reaction force herein after) is received by a frictional force produced by tightening the bolt-like object to the paper feed tray or main apparatus body. When the tray positioning mechanism is strongly pressed on the paper feed tray or main apparatus body to apply a strong contact reaction force, or when the bolt-like object is tightened only insufficiently, the position of the bent plate-like contact member attached to the paper feed tray or main apparatus body tends to shift in the tray moving direction, and therefore the position of the contact portion also tends to shift. This results in a problem that the adjusted paper setting position tends to deviate from the image forming position.

In the construction in which the position adjusting plate portion of the bent plate-like contact member defines a plurality of bolt receiving bores arranged in the tray moving direction, and a bolt-like object is passed through one of the bolt receiving bores and screwed to the paper feed tray or the main apparatus body to attach the bent plate-like contact member to the paper feed tray or the main apparatus body, a contact reaction force will be received in the state of the bolt-like object contacting the inner peripheral surface of the bolt receiving bore. It is then possible to prevent the position of the bent plate-like contact member attached to the paper feed tray or the main apparatus body from shifting in the tray moving direction. As a result, the optical axis of an image may be adjusted in a way to avoid a deviation the adjusted position of the paper setting position (which may be called simply the adjusted position hereafter) from the image forming position.

However, an operation for adjusting the optic axis of an image must be carried out by once removing the bolt-like object from the paper bed tray or the main apparatus body, passing the bolt-like object through a desired one of the bolt receiving bores and tightening the bolt-like object to the paper feed tray or the main apparatus body. Thus, the optical axis adjusting operation of an image is complicated and troublesome.

This invention has been made having regard to the state of the art noted above, and its object is to provide a paper feeder for an image forming apparatus which can prevent a deviation of an adjusted position by a simple operation to adjust an optical axis of an image.

SUMMARY OF THE INVENTION

This invention provides a paper feeder for an image forming apparatus comprising:

a paper feed tray attachable to a tray receiver of a main apparatus body by moving in a tray moving direction perpendicular to a direction of feeding paper loaded in the feed tray; and a tray positioning mechanism for contacting one of the paper feed tray and the main apparatus body as the paper feed tray is attached to the tray receiver, to restrict movement in an attaching direction of the paper feed tray, the tray positioning mechanism being attached to the other of the paper feed tray and the main apparatus body;

the tray positioning mechanism having a contact portion for contacting one of the paper feed tray and the main apparatus body, a position of the contact portion being adjustable in the tray moving direction;

a first characterizing feature being that the tray positioning mechanism includes a fixed member fixed to the other of the paper feed tray and the main apparatus body, and a contact member having the contact portion, the fixed member and the contact member being relatively movably connected to each other, at least one of the fixed member and the contact member having a plurality of reaction force receiving surfaces formed continuously for receiving a contact reaction force of the tray positioning mechanism when the fixed member and the contact member are in contact with each other, the reaction force receiving surfaces being switchable to an operative state to vary and adjust the position in the tray moving direction of the contact portion.

The fixed member fixed to the other of the paper feed tray and the main apparatus body, and the contact member having the contact portion, are relatively movably connected to each other. At least one of the fixed member and the contact member has a plurality of reaction force receiving surfaces formed continuously for receiving a contact reaction force of the tray positioning mechanism when the fixed member and the contact member are in contact with each other. The reaction force receiving surfaces are switchable to an operative state to vary and adjust the position in the tray moving direction of the contact portion. Thus, the contact member is moved without separating it from the fixed member, to switch selectively the plurality of reaction force receiving surfaces to the operative state. In this way, the above-construction can vary and adjust the position of the contact portion in the tray moving direction.

That is, by moving the contact member without separating it from the fixed member to select certain of the reaction force receiving surfaces to be operative, the position of the contact portion may be varied and adjusted in the tray moving direction. This construction can simplify the operation to adjust an optical axis of an image.

The contact reaction force of the tray positioning mechanism is received by the fixed member and the contact member contacting each other through the reaction force receiving surfaces. This prevents the position of the contact member relative to the paper feed tray or the main apparatus body from shifting in the tray moving direction. As a result, the optical axis of an image may be adjusted in a way that the adjusted position will not shift.

Thus, the paper feeder for an image forming apparatus according to this invention can adjust the optical axis of an image to prevent a deviation of an adjusted position while simplifying the adjusting operation.

A second characterizing feature of the invention lies in that, in addition to the first characterizing feature:

the fixed member and the contact member are formed cylindrical and define the reaction force receiving surface is extending stepwise circumferentially thereof for contacting each other;

the fixed member and the contact member are connected to each other to be movable relative to each other along the tray moving direction, biased toward each other in the tray moving direction, and rotatable about an axis of rotation extending in the tray moving direction; and the operative state of the stepped reaction force receiving surfaces is changeable by rotating the contact member about the axis of rotation.

With the contact member moved away from the fixed member against the biasing force, the contact member is rotated about the axis of rotation to place the stepped reaction force receiving surfaces in a desired operative state. Subsequently, the force that has moved the contact member against the biasing force is canceled. As a result, the fixed member and contact member are placed in contact with each other, with the mutual stepped reaction force receiving surfaces set to the desired operative state. Thus, the contact portion may be changed and adjusted to a target position in the tray moving direction.

With the above construction, the optical as adjusting operation of an image may be carried out without using a tool. The optical axis adjusting operation of an image may be further simplified.

A third characterizing feature of the invention lies in that, in addition to the first characterizing feature:

the contact member has a plate-like portion extending in the tray moving direction;

the plate-like portion defines bent slits having stepped edges acting as the plurality of reaction force receiving surfaces, and shaped to allow the stepped edges;

bolt-like objects acting as the fixed member are passed through the slits and screwed to the other of the paper feed tray and the main apparatus body, thereby attaching the contact member; and the bolt-like objects are placed in contact with selectively part of steps of the slits by moving the contact member with the slits engaging the bolt-like objects.

The bolt-like objects are loosened to allow the contact member to move while remaining engaged with the slits.

Then, with bolt-like objects engaged with the slits, the contact member is moved to place bolt-like objects in contact with desired steps of the stepped edges of the slits. Subsequently, the bolt-like objects are tightened to the paper feed tray or the main apparatus body to attach the contact member to the paper feed tray or the main apparatus body. As a result, the contact portion may be adjusted and varied to a desired position in the tray moving direction.

Thus, a suitable device is provided for simplifying the optical axis adjusting operation.

As a fourth characterizing feature of the invention, the tray positioning mechanism is attached to the paper fed tray or the main apparatus body to be rotatable about a axis of rotation extending perpendicular to the tray moving direction;

the tray positioning mechanism has a continuous bent peripheral surface around the axis of rotation, the peripheral surface defining a plurality of surfaces having different distances from the axis of rotation and arranged in order of their distances, each of the surfaces acts as the contact portion; and the position of the contact portion is adjustable in the tray moving direction by rotating the tray positioning mechanism about the axis of rotation.

The tray positioning mechanism attached to the paper feed tray or the main apparatus body is rotated about the axis of rotation, to place, in a position for allowing the mechanism to contact the main apparatus body or the paper feed tray, a desired one of the plurality of surfaces each acting as a contact portion. In this way, the position of the contact portion is adjusted in the tray moving direction.

That is, by rotating the tray positioning mechanism about the axis of rotation, the position of the contact portion can be adjusted in the tray moving direction. This construction may simply the optical axis adjusting operation of an image.

The contact reaction force of the tray positioning mechanism is received by the surface portion acting as the contact portion and contacting the main apparatus body or the paper feed tray. This prevents the position of the contact member relative to the paper feed tray or the main apparatus body from shifting in the tray, movie direction. As a result, the optical axis of an image may be adjusted in a way that the adjusted position will not shift.

Thus, the paper feeder for an image forming apparatus according to this invention can adjust the optical a of an image to prevent a deviation of an adjusted position while simplifying the adjusting operation.

DESCRIPTION OF THE PREFERRED EMBODIMENTS

First Embodiment

A first embodiment of this invention will be described hereinafter with reference to the drawings, in which the invention is applied to a paper feeder of an electronic copying machine acting as an image forming apparatus.

Figure 1:
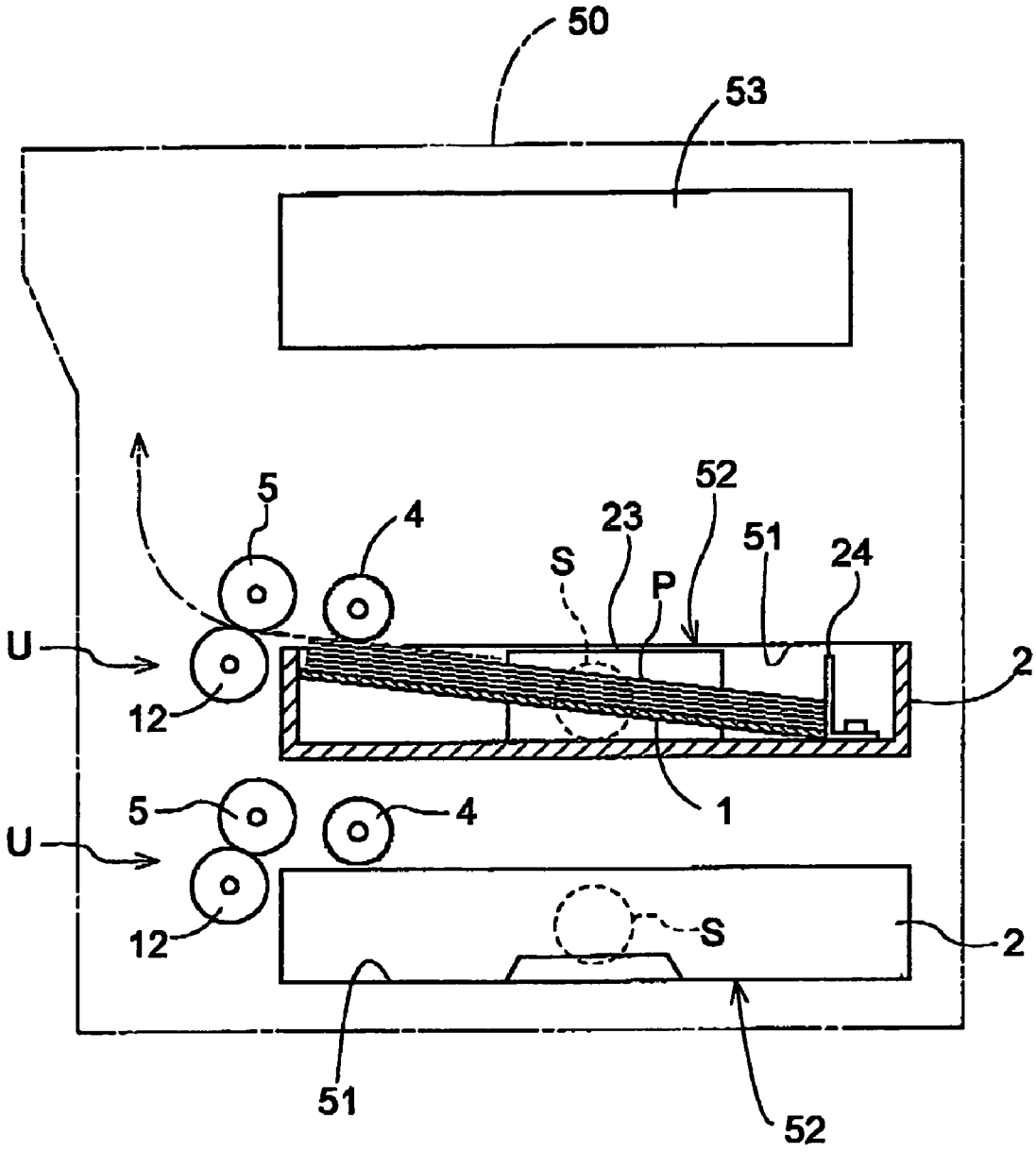
FIG. 1 is a schematic view of an electronic copying machine having a paper feeder according to this invention.

An electronic copying machine is known, and will therefore be described only briefly. As shown in FIG. 1, the electronic copying machine includes a casing 50 defining the a plurality of tray receivers 62 each having a loading opening 51. A paper feeder includes paper feed units U having paper feed trays 2 provided for the respective tray receivers 52. A tray selector (not shown) selects one of the paper feed trays 2, from which paper P is fed one sheet at a time. The paper P fed is transported to an image forming station 53 where images are formed on the paper P.

The plurality of paper feed units U provided for the respective tray receivers 52 have the same construction. Thus, one of the paper feed units U will be described hereinafter.

Figure 2:
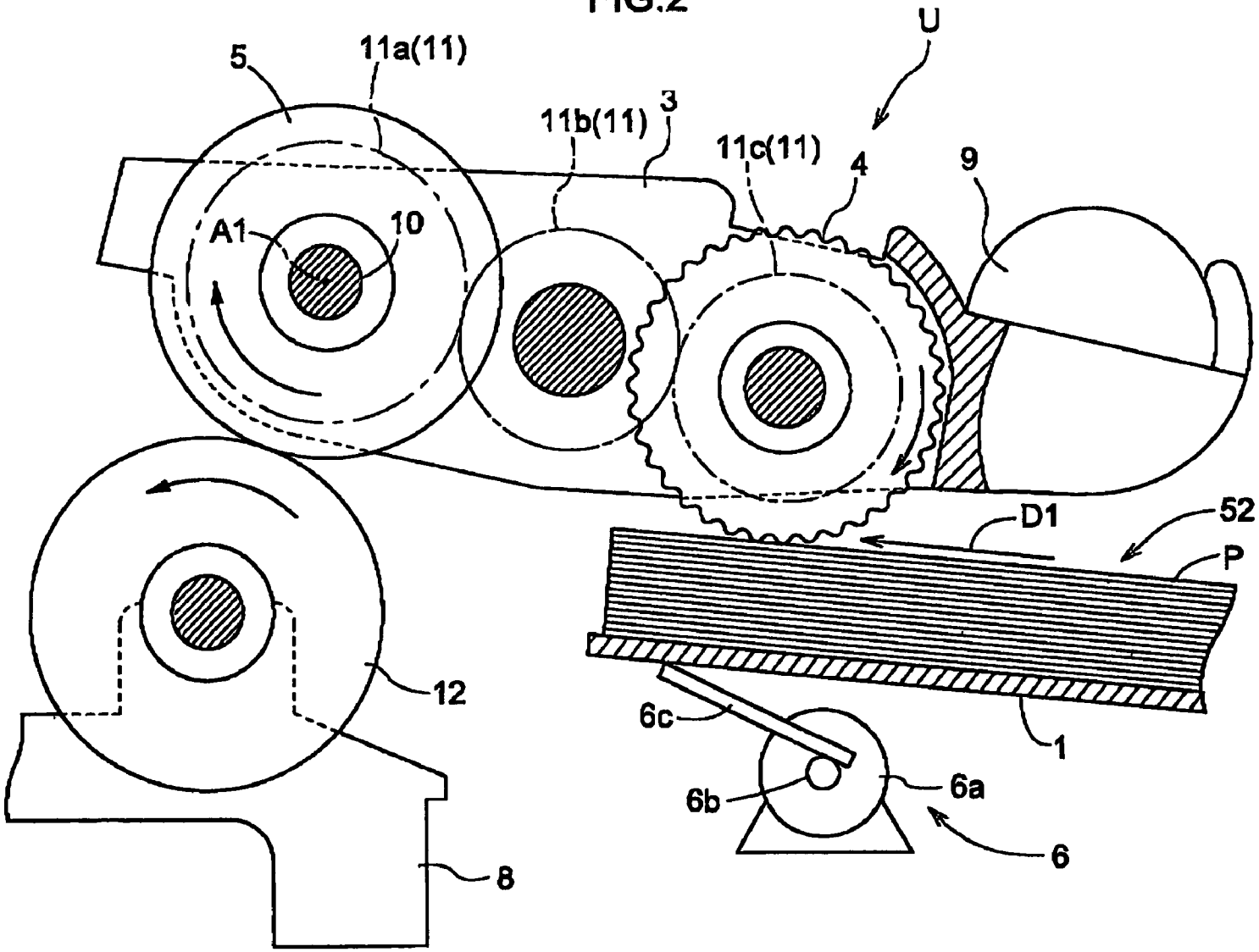
FIG. 2 is view in vertical section of the paper feeder according to the inventions
Figure 3:
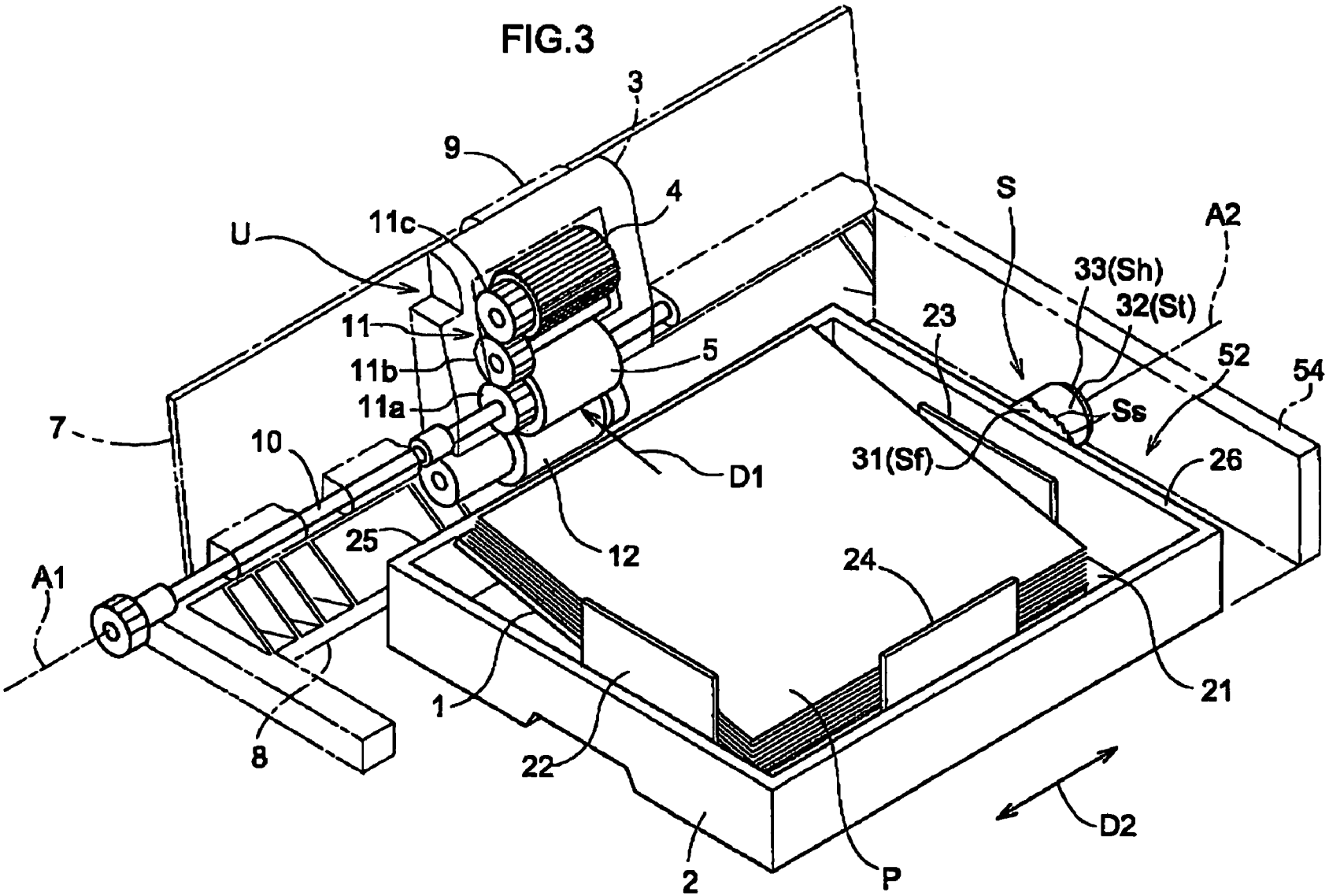
FIG. 3 is a perspective view of a paper feeder in a first embodiment.

As shown in FIGS. 2 and 3, the paper feed unit U includes the paper feed tray 2 having a vertically movable support plate 1 for supporting paper P and attachable to the tray receiver 62 of the main machine body by moving in a tray moving direction D2 extending perpendicular to a feed direction D1 of the paper P on the support plate 1, and a pickup roller 4 and a feed roller 5 for feeding one sheet at a time of the paper P from the paper feed tray 2 attached to the tray receiver 52. The paper feed unit U further includes a frame 3 supported above the tray receiver 52 to be rockable about a pivot axis A1 extending horizontally, a lift device 6 for vertically moving the support plate 1 of the paper feed tray 2 attached to the tray receiver 52, and a tray positioning mechanism S provided for the paper feed tray 2 for contacting a stopper plate 5 of the main machine body as the paper feed tray 2 is loaded into the tray receiver 62, to restrict movement in a loading direction of the paper feed tray 2.

The tray positioning mechanism S has a contact portion Sh for contacting the stopper plate 54 of the main machine body. This contact portion Sh is adjustable in the tray moving direction.

As shown in FIG. 3, the frame 3 is supported by a housing 7 to be rockable about the pivot axis A1. The housing 7 rockably supporting the frame 3 is supported by a support frame 8 attached to the main machine body, to have the pivot axis A1 extending horizontally and to be rockable about the pivot axis A1.

This housing 7 may be positioned in each of a lower, paper feed position and an upper, retreat position.

FIG. 2 shows the frame 8 and other components in a state where the housing 7 is positioned in the paper feed position. FIG. 3 shows a state where the housing 7 is positioned in the retreat position.

Figure 8:
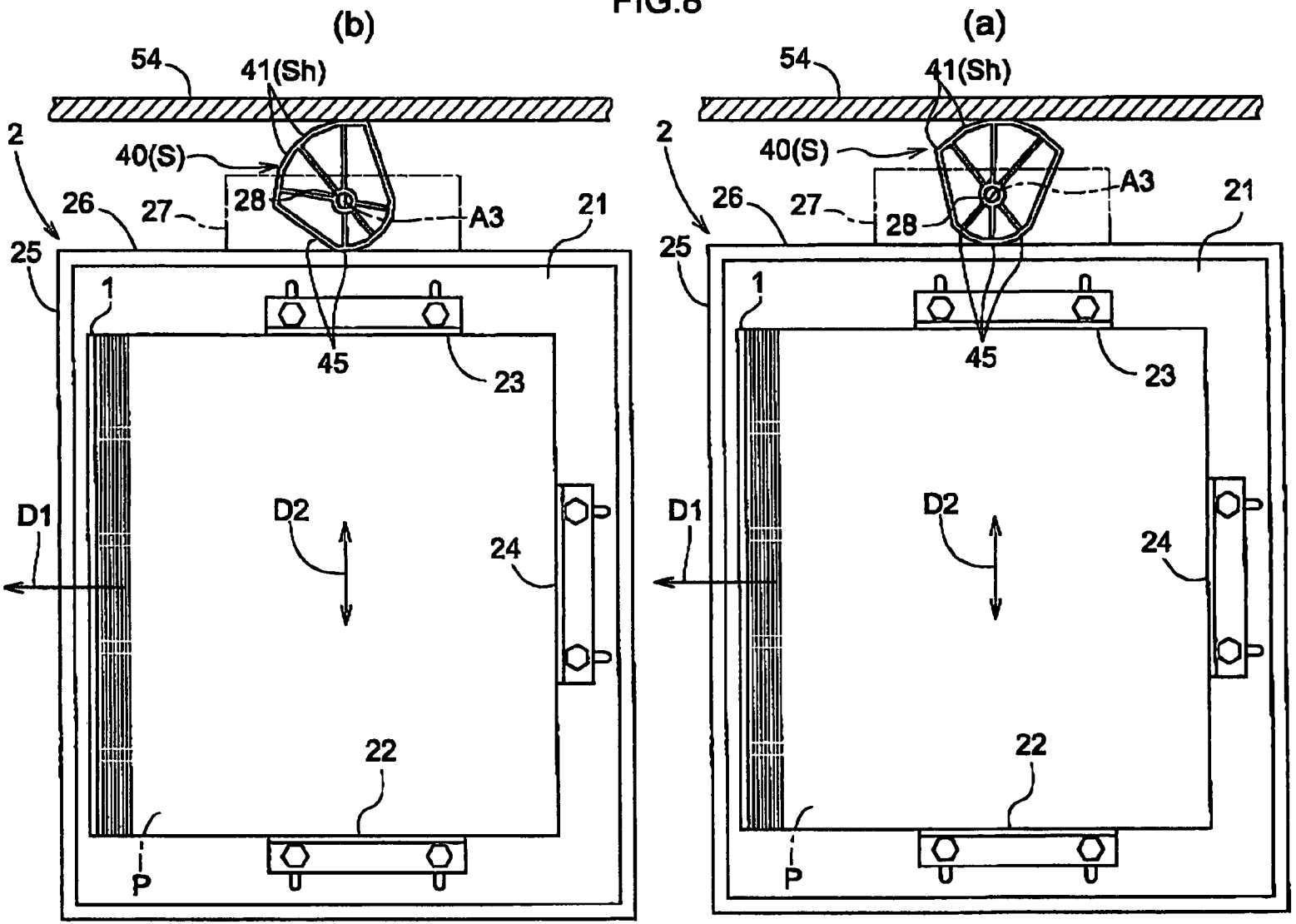
FIG. 8 is a plan view of a paper feeder in a third embodiment.

As shown in FIGS. 2 and 8, the frame 3 has the feed roller 5 rotatable about the pivot A1, and the pickup roller 4 rotatable about axis spaced from the pivot axis A1 and extending parallel to the pivot axis A1. Further, the pickup roller 4 has a weight 9 disposed at the side thereof remote from the pivot axis A1.

The housing 7 has a rotary shaft 10 (FIG. 3) connected to the feed roller 5 to be coaxial with the pivot axis A1. The rotary shaft 10 and pickup roller 4 are interlocked through a gear mechanism 11 including three gears 11*a*, 11*b* and 11*c*.

The rotary shaft 10 is rotatable by a feed motor (not shown) to rotate the feed roller 5 and pickup roller 4.

Though not shown, the housing 7 has a lower limit positioning portion for limiting a downward rocking of the frame 3.

With the frame 3 stopped making downward rocking by the lower limit positioning portion, the housing 7 can rock in unison with the frame 3 between the feed position and the retreat position.

With the housing 7 set to the feed position, the frame 3 can be raised against the biasing force of the weight 9.

As shown in FIG. 2, the lift device 6 includes a lift motor 6*a* having an output shaft 6*b*, and a lift arm 6*c* attached to the output shaft 6*b*. The lift device 6 is constructed to push up, with the lift arm 6*c*, the support plate 1 of the paper feed tray 2 loaded in the tray receiver 52. The lift motor 6*a* is rotatable forward and backward to swing the lift arm 6*c* forward and backward, thereby to raise and lower the support plate 1.

A control unit, not shown, controls operation of the lift device 5 for raising the support plate 1 to place the pickup roller 4 in contact with the upper surface of paper P in the paper feed tray 2 and further to raise the frame 3. As a result, the pickup roller 4 presses with a fixed pressure on the upper surface of paper P.

The support frame 8 has a driven roller 12 for contacting the feed roller 5 when the housing 7 is positioned in the feed position.

When the feed motor is operated to rotate the feed roller 5 and pickup roller 4, the driven roller 12 is rotated by the rotation of the feed roller 5. Then, the pickup roller 4 feeds the paper P toward a position between the feed roller 5 and driven roller 12, and the feed roller 6 and driven roller 12 transport the paper P.

Next, the paper feed tray 2 will be described further with reference to FIGS. 3 and 4.

The paper feed tray 2 includes, mounted on a bottom plate 21 thereof, a front adjusting plate 22 disposed downstream in the tray moving direction, and a rear adjusting plate 23 disposed upstream in the tray moving direction, the two adjusting plates 22 and 23 being spaced apart and slidable along the tray moving direction. The paper feed tray 2 further includes a side adjusting plate 24 disposed rearwardly in the feed direction to be slidable along the feed direction.

Though not described in detail or shown in the drawings, a fixing device is provided for fixing the front adjusting plate 22 and rear adjusting plate 23 to respective positions corresponding to sizes (e.g. A4 size, B5 size and so on) of the paper P in the tray moving direction. A Hag device is provided also for fixing the side adjusting plate 24 to positions corresponding to the sizes of the paper P in the feed direction.

Each of the front adjusting plate 22, rear adjusting plate 23 and side adjusting plate 24 is fixed to a position corresponding to the size of the paper P stacked on the support plate 1. Then, the front adjusting plate 22, rear adjusting plate 23, side adjusting plate 24 and a feed direction front plate 25 disposed in the paper feed tray 2 and forwardly in the feed direction, guide the four sides of the paper P stacked on the support plate 1.

Next, the tray positioning mechanism S will be described further with reference to FIGS. 4 through 6.

The tray positioning mechanism S is attached to the paper feed tray 2 (specifically, to a back plate 26 disposed forwardly in the tray moving direction).

In the first embodiment, the tray positioning mechanism S includes a fixed member Sf fixed to the back plate 26 of the paper feed tray 2, and a contact member St having the contact portion Sh. The fixed member Sf and contact member St are relatively movably connected to each other. Each of the fixed member Sf and contact member St has a plurality of reaction force receiving surfaces Ss formed continuously for receiving a contact reaction force of the tray positioning mechanism S when the fixed member Sf and contact member St are in contact with each other. The reaction force receiving surface Ss are switchable to an operative state to vary and adjust the position in the tray moving direction of the contact portion Sh. Each of the reaction force receiving surfaces Ss is formed in a direction perpendicular to the tray moving direction.

In the first embodiment, the fixed member Sf is in the form of a cylindrical fixed member 31, while the contact member St is in the form of a cylindrical contact member 32. The cylindrical fixed member 31 and cylindrical contact member 32 define the reaction force receiving surfaces Ss extending in stepped form circumferentially thereof for contacting each other. The cylindrical fixed member 31 and cylindrical contact member 32 are connected to each other to be movable relative to each other along the tray moving direction, biased toward each other in the tray moving direction, and rotatable about an axis of rotation A2 extending in the tray moving direction. The operative state of the stepped reaction force receiving surfaces Ss is changeable by rotating the cylindrical contact member 32 about the axis of rotation A2.

The cylindrical fixed member 31 and cylindrical contact member 32 will be described further with reference to FIG. 6.

The cylindrical fixed member 31 has a closed rear end, and a cylindrical guide 31*b* extending forward along the axis of the cylindrical fixed member 31 from a back surface of the closed rear and 31*a*.

The cylindrical fixed member 31 has a forward end circumferentially divided into four equal parts each defining six steps of the same shape. Each of these four stepped portions acts as a stepped reaction force receiving surface Ss for contacting the stepped reaction force receiving surfaces Ss of the cylindrical contact member 32 described hereinafter.

The cylindrical contact member 32 has a closed forward end 32*a*, and a cylindrical rod 32*b* axially extending rearward from a back surface of the closed forward end 32*a*.

The cylindrical contact member 32 has a rear end circumferentially divided into four equal parts each defining six steps of the same shape. These four stepped portions are engageable with the stepped portions at the forward end of the cylindrical fixed member 31 in a way to vary the number of engaging steps. Each of these four stepped portions acts as a stepped reaction force receiving surface Se for contacting the stepped reaction force receiving surfaces Ss of the cylindrical fixed member 31.

An elastic member 33 formed of rubber or the like is attached to the forward end surface of the cylindrical contact member 32 to act as the contact portion Sh.

The stepped reaction force receiving surfaces Ss of the cylindrical fixed member 31 and cylindrical contact member 32 have a level difference set to 1 ml, for example.

The back plate 26 of the paper feed tray 2 defines a rod receiving bore 26*a* in a position where the tray positioning mechanism S is attached, in which the rod 32*b* of the cylindrical contact member 32, is freely receivable.

The cylindrical fixed member 81 is attached to the back plate 26 of the paper feed tray 2, with the closed rear end 3*a* placed in contact with an outer surface of the back plate 26, and the cylindrical guide 31*b* in communication with the rod receiving bore 26*a* of the back plate 26. In the state of the cylindrical fixed member 81 being attached to the back plate 26, the cylindrical guide 81*b* extends in the tray moving direction.

The cylindrical contact member 32 is supported by the cylinder fed member 31, with the rod 32*b* extending through the cylindrical guide 31*b* of the cylindrical fixed member 31 and the rod receiving bore 26*a* of the back plate 26 of the paper feed tray 2, to be rotatable relative to the cylindrical fixed member 31 as guided by the cylindrical guide 31*b*. A coil spring 35 is mounted in a compressed state between a spring bearing 34 attached at the forward end of the rod 82*b* projecting from the rod receiving bore 26*a* and an inner surface of the back plate 26.

The cylindrical fixed member 31 and cylindrical contact member 32 are assembled together and attached to the outer surface of the back plate 26 of the paper feed tray 2 as described above. In this state, the cylindrical fixed member 31 and cylindrical contact member 32 are connected to each other such that the cylindrical contact member 82 is relatively movable along the tray moving direction, biased in the tray moving direction toward the cylindrical fixed member 31, and rotatable about the axis of rotation A2 extending along the tray moving direction.

The cylindrical contact member 32 is rotated about the axis of rotation A after being drawn against the biasing force of the coil spring 35 to a position not interfering with the cylindrical fixed member 31. In this way, as shown in FIGS. 4 and 5, a change is made in the number of reaction force receiving surfaces Ss to contact each other, among the stepped reaction force receiving surfaces Ss of the cylindrical fixed member 31 and stepped reaction force receiving surfaces Ss of the cylindrical contact member 32. As a result, the position of the elastic member 33 acting as the contact portion Sh is adjusted in the tray moving direction.

That is, those contacting each other of the stepped reaction force receiving surfaces Ss of the cylindrical fixed member 31 and the stepped reaction force receiving surfaces S of the cylindrical contact member 32 assume the operative state.

Figure 4:
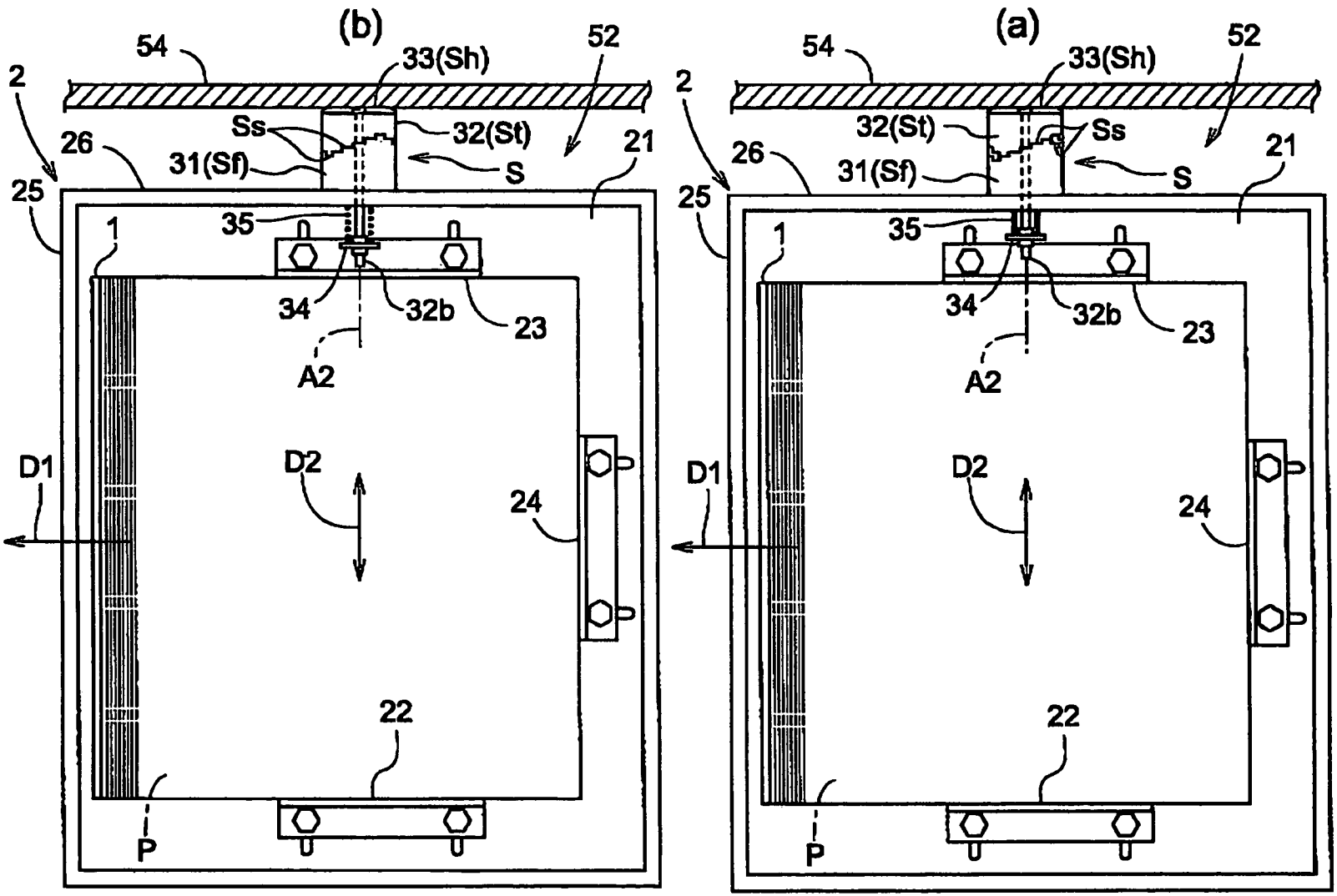
FIG. 4 is a plan view of the paper feeder in the first embodiment.
Figure 5:
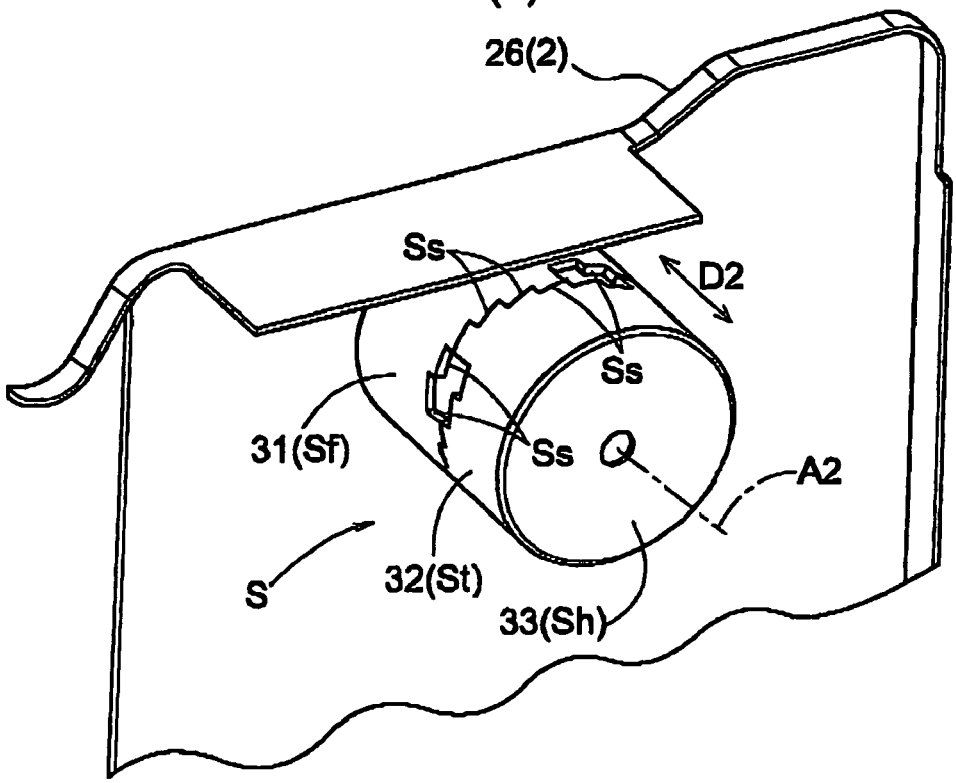
FIG. 5 is a perspective view showing a tray positioning mechanism of the paper feeder in the first embodiment.
Figure 5:
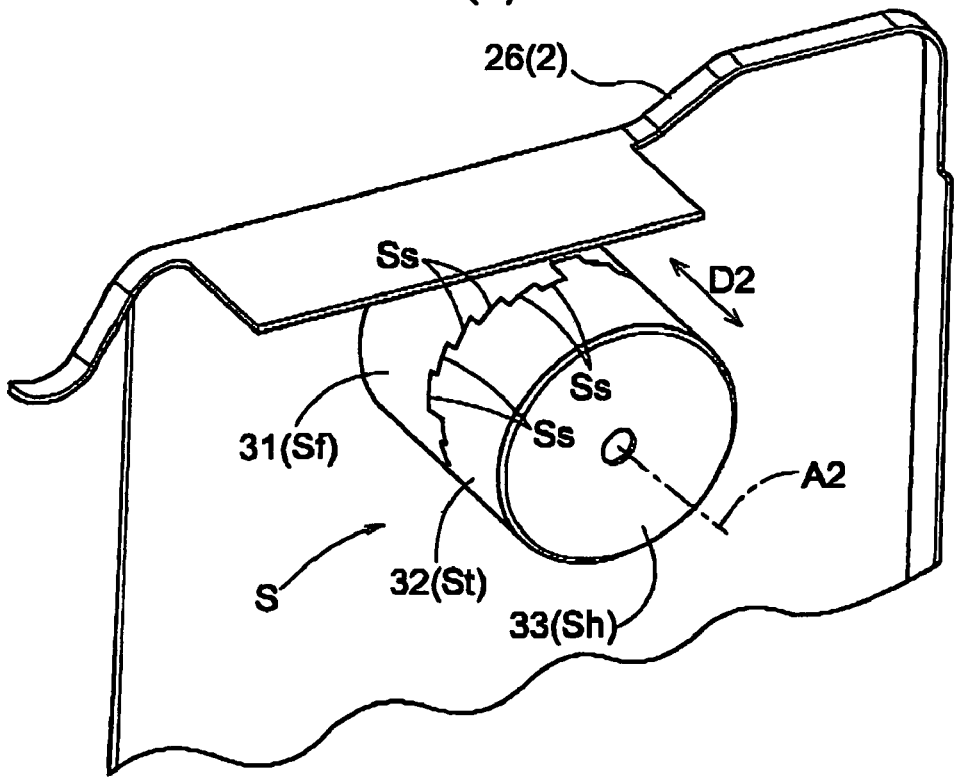
Figure 6:
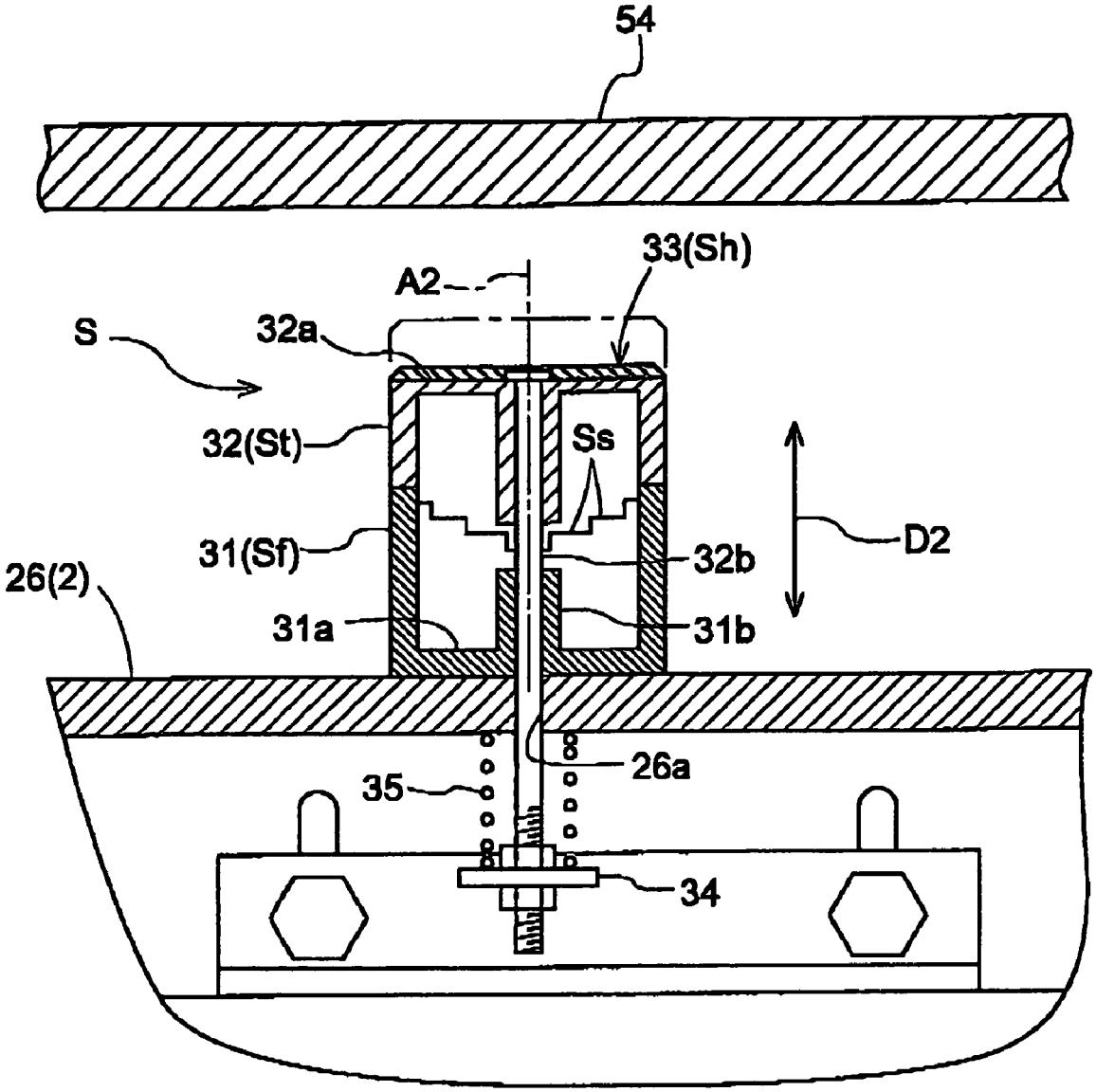
FIG. 6 is a cross section of the tray positioning mechanism of the paper feeder in the first embodiment.

As shown in (b) of each of FIGS. 4 and 5, when all of the stepped reaction force receiving surfaces Ss of the cylindrical fixed member 31 and all of the stepped reaction force receiving surfaces Ss of the cylindrical contact member 32 are in contact with each other, the contact portion Sh is located in a rearmost position in the tray moving direction. As a result, the paper feed tray 2 will be loaded deepest in the tray moving direction.

Though not shown, when one of the stepped reaction force receiving surfaces Ss of the cylindrical fixed member 31 and one of the stepped reaction force receiving surfaces Ss of the cylindrical contact member 32 are in contact with each other, the contact portion Sh is located in a foremost position in the tray moving direction. As a result, the paper feed tray 2 will be loaded least deep in the tray moving direction.

Where the level difference of the stepped reaction force receiving surfaces Ss is set to 1 min as noted hereinbefore, the position in the tray moving direction of the contact portion Sh may be adjusted and varied in units of 1 mm, and thus the loading position in the tray moving direction of the paper feed tray 2 may be adjusted and varied in units of 1 mm.

The elastic member 33 is attached to the forward end surface of the cylindrical contact member 32 to act the contact portion Sh for absorbing a shock occurring when the tray positioning mechanism S contacts the stopper plate 54 of the main machine body. This can check collapse of the sheets of paper P loaded on the support plate 1 of the paper feed tray 2.

A second and a third embodiments of this invention will be described hereinafter. Each of these, embodiments differs from the first embodiment only in the construction of the tray positioning mechanism S. Thus, like reference numerals will be used to identify like parts which are the same as in the first embodiment and will not be described again to avoid unnecessary repetition. The following description will be centered on the tray positioning mechanism S.

Second Embodiment

Figure 7:
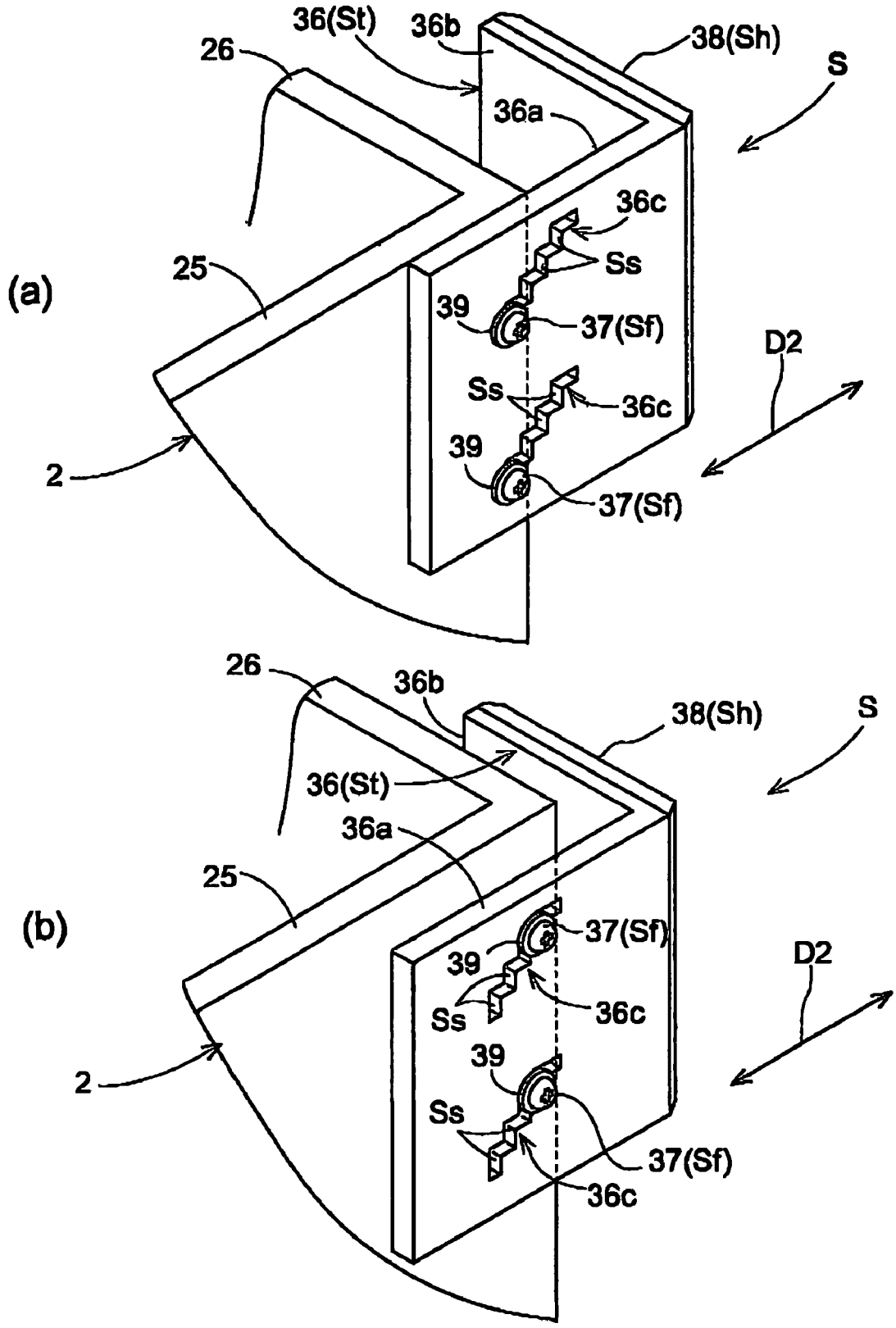
FIG. 7 is a perspective view of a tray positioning mechanism of a paper feeder in a second embodiment.

In the second embodiment, as in the first embodiment, as shown in FIG. 7, a tray positioning mechanism S is provided for the paper feed tray 2. The tray positioning mechanism S includes fixed members Sf fixed to the paper feed tray 2, and a contact member St having the contact portion Sh. The members Sf and contact member St are relatively movably connected to each other. The contact member St has a plurality of reaction force receiving surfaces Ss formed continuously for receiving a contact reaction force of the tray positioning mechanism S when the fixed member Sf and contact member St are in contact with each other. The reaction force receiving surfaces Ss are switchable to an operative state to vary and adjust the position in the tray moving direction of the contact portion Sh. Each of the reaction force receiving surfaces Ss is armed in a direction perpendicular to the tray moving direction.

In the second embodiment, the contact member St is in the form of a bent plate-like contact member 36 having a position adjusting plate portion 36*a* extending in the tray moving direction, and a contact plate portion 36*b* extending in the feed direction. The position adjusting plate portion 36*a* of the bent plate-like contact member 36 defines bent slits 36*c* having stepped edges acting as the plurality of reaction force receiving surfaces Ss, and shaped to follow the stepped edges. Bolt-like objects 37 acting as the fixed members Sf are passed through the slits 36*c* and screwed to the paper feed tray 2, thereby attaching the bent plate-like contact member 36. By moving the bent plate-like contact member 36 with the elite 36*c* engaging the bolt-like objects 37, the bolt-like objects 37 may be placed in contact with selectively part of steps of the slits 36*c*.

To describe this feature further, the slits 36*c* define the stepped edges acting as the plurality of reaction force receiving surfaces Ss located deep in the tray moving direction. The steps are arranged in the tray moving direction, with each step extending in a direction perpendicular to the tray moving direction.

That is, the plurality of reaction force receiving surfaces Ss are formed stepwise and arranged in the tray moving direction, with each surface extending in a direction perpendicular to the tray moving direction, and facing rearward to the tray moving direction.

One of the plurality of reaction force receiving surfaces Ss is selected and placed in contact with each bolt-like object 37 screwed to the paper feed tray 2, thereby being able to receive a contact reaction occurring when the tray positioning mechanism S contacts the stopper plate 54 of the main machine body.

In this embodiment, the position adjusting plate portion 36*a* of the bent plate-like contact member 36 defines two slits 36*c* arranged along the direction perpendicular to the tray moving direction.

A plate-like elastic member 38 formed of rubber or the like is attached to the forward surface of the contact plate portion 36*b* of the bent plate-like contact member 36 to act as the contact portion Sh.

Two bolt-like objects 87 each fitted with a washer 39 are passed respectively through the two slits 36*c* of the bent plate-like contact member 36. In this state, the bolt-like objects 37 are screwed to an end region deep in the tray moving direction of the feed direction front plate 25 of the paper feed tray 2, thereby attaching the bent plate-like contact member 36 to the paper feed tray 2.

The two bolt-like objects 37 are loosened or enabling movement of the bent plate-like contact member 36 while the bolt-like objects 37 engaged with the slits 36*c*. Then, as shown in FIG. 7 (*a*) and (*b*), a selection is made of those of the stepped reaction force receiving surface portions Ss for contacting the bolt-like objects 37. In this way, the loading position in the tray moving direction of the paper feed tray 2 may be adjusted and varied.

The elastic member 38 is attached to the forward surface of the contact plate portion 86*b* of the bent plate-like contact member 86 to act as the contact portion Sh for absorbing a sock occurring when the tray positioning mechanism S contacts the stopper plate 54 of the main machine body. This can check collapse of the sheets of paper P loaded on the support plate 1 of the paper feed tray 2.

Third Embodiment

Figure 9:
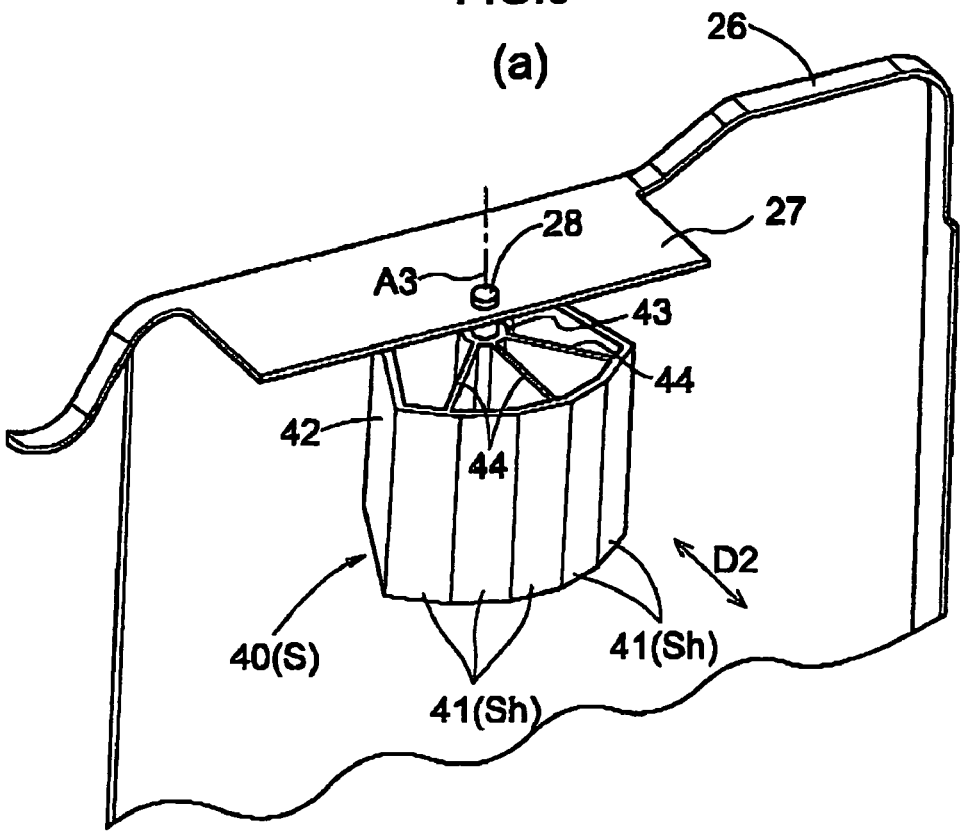
FIG. 9 is a perspective view of a tray positioning mechanism of the paper feeder the third embodiment.
Figure 9:
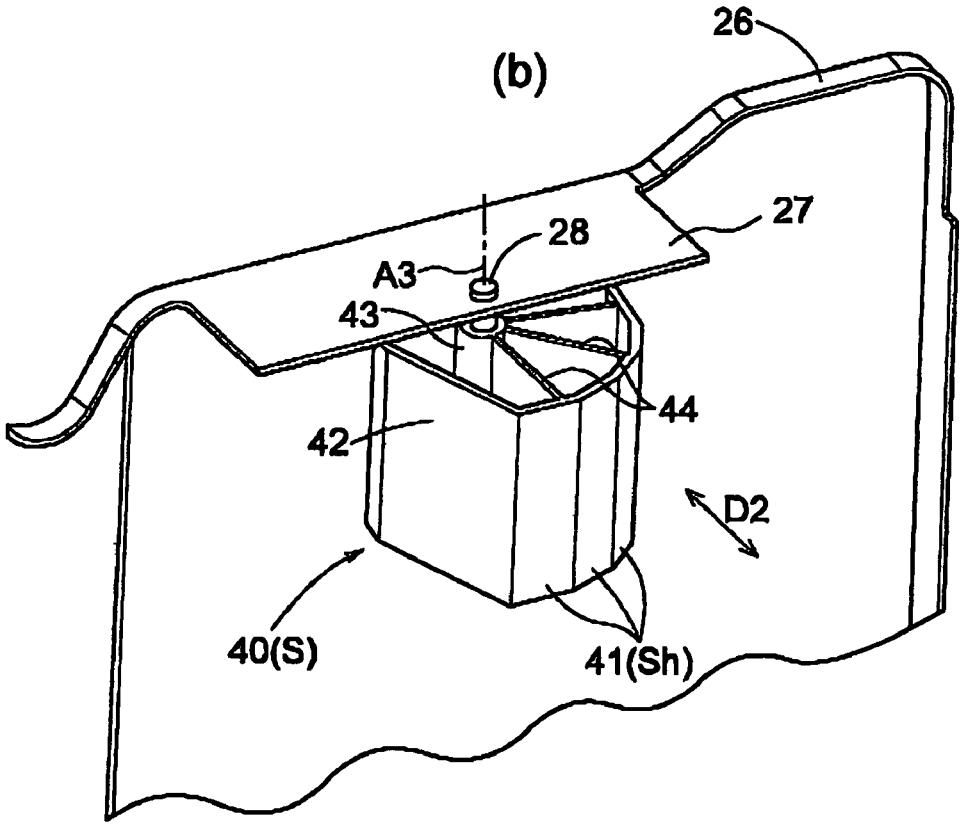

In the third embodiment, as in the first embodiment, as shown in FIGS. 8 and 9, a tray positioning mechanism S is provided for the paper feed tray 2.

In the third embodiment, the tray positioning mechanism S includes a wheel type contact member 40 having a wheel-like sectional shape in a plane perpendicular to the axis of rotation thereof. The wheel type contact member 40 is attached to the paper feed tray 2 to be rotatable about an axis of rotation A3 extending perpendicular to the tray moving direction. The wheel type contact member 40 has a continuous bent peripheral surface around the axis of rotation A3. The peripheral surface defines a plurality of contact surfaces 41 (corresponding to the surfaces noted hereinbefore) having different distances from the axis of rotation A3, and arranged in order of their distances. Each of the contact surfaces 41 acts as a contact portion Sh. By rotating the wheel type contact member 40 about the axis of rotation A3, the position of the contact portion Sh is adjustable in the tray, moving direction.

The wheel type contact member 40 will be described further with reference to FIG. 10. The wheel type contact member 40 includes a peripheral wall 42, a cylindrical portion 43 disposed inside the peripheral wall 42, and a plurality of spoke-like portions 44 interconnecting the peripheral wall 42 and cylindrical portion 43.

The outer surface of the peripheral wall 42, at one side with respect to the cylindrical portion 48, defines a circumferentially continuous bent surface including the plurality of contact surfaces 41 having different distances from the center of the cylindrical portion 48 and arranged in order of their distances. The outer surface, at the other side with respect to the cylindrical portion 43, defines a circumferentially continuous bent surface including a plurality of receiving surfaces 45 extending parallel to the respective contact surfaces 41 and having an equal distance from the center of the cylindrical portion 43.

In this embodiment, the peripheral wall 42 provides five sets of contact surface 41 and receiving surface 45 having different distances between contact surface 41 and receiving surface 45 by units of 1 mm from 48 to 52 mm.

The wheel type contact member 40 is formed of a synthetic resin to the shape described above to have elasticity.

As shown in FIG. 9, the paper feed tray 2 has a shaft support portion 27 formed in the front surface side of the back plate 26 to project therefrom deep in the tray moving direction, and a shaft 28 attached to the shaft support portion 27 to extend vertical.

The wheel type contact member 40 has the cylindrical portion 43 fitted on the shaft 28. Consequently, the wheel type contact member 40 is rotatable about the axis of rotation A3 extending in the vertical direction which is a direction perpendicular to the tray moving direction, with the receiving surfaces 45 contacting the surface of the back plate 26 of the paper feed tray 2.

Figure 10:
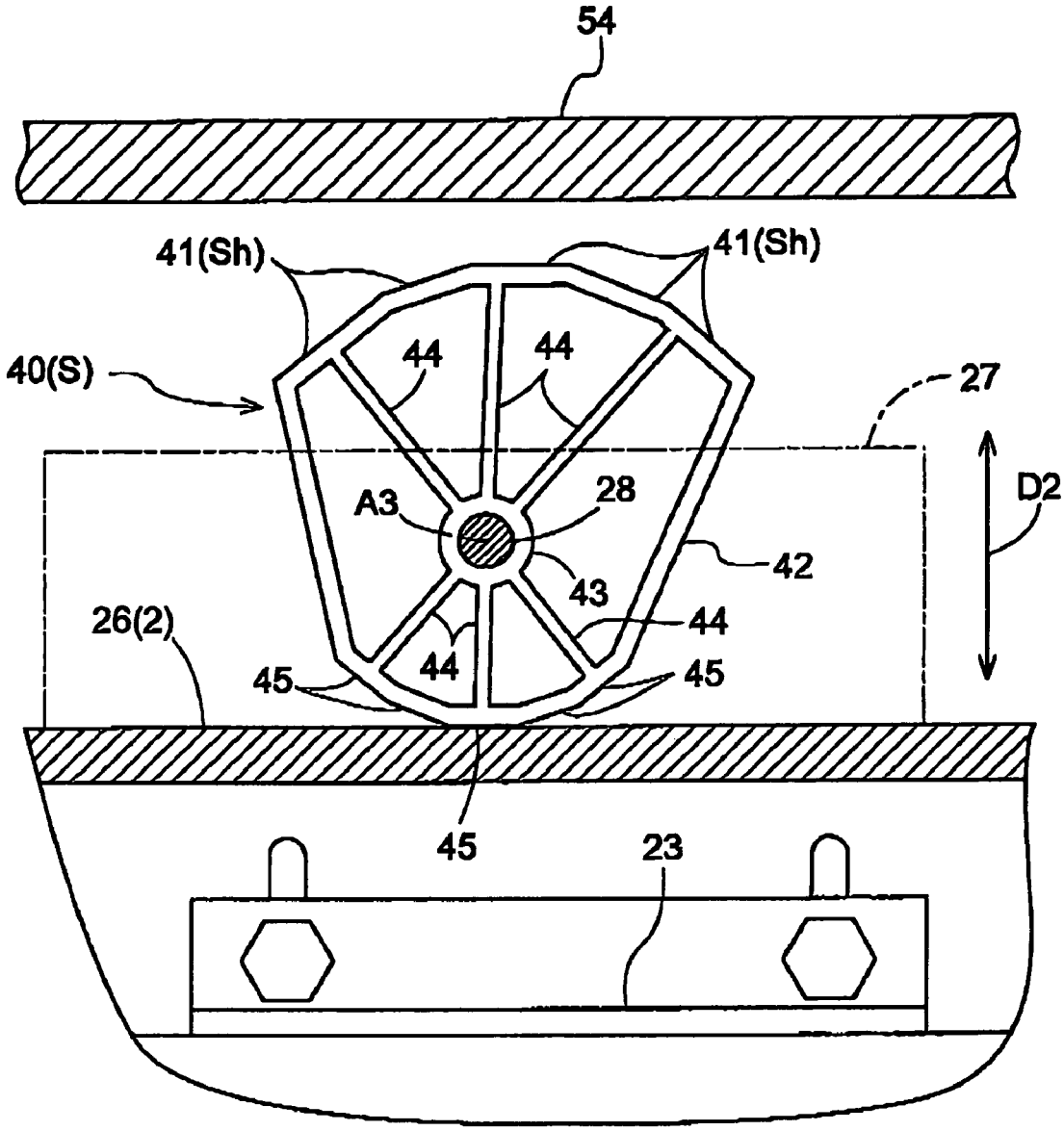
FIG. 10 is a plan view showing the tray positioning mechanism of the paper feeder the third embodiment.

As shown in FIGS. 9 and 10, the wheel type contact member 40 is rotated about the axis of rotation A3 to change the contact surfaces 41 for facing in parallel relationship the stopper plate 54 of the main machine body. As a result, the position of the contact portion Sh is adjusted in the tray moving direction.

The wheel type contact member 40 is formed elastic to absorb a shock occurring when the wheel type contact member 40 contacts the stopper plate 54 of the main machine body. This can check collapse of the sheets of paper P loaded on the support plate 1 of the paper feed tray 2.

Other Embodiments

Other embodiments will be described next.

(a) In the above embodiments, the tray positioning mechanism S is attached to the paper feed tray 2, or to the paper bed tray 2 of the main machine body. The tray positioning mechanism S may be attached to the main machine body itself.

In this case, the tray positioning mechanism S is attached to the stopper plate 54 of the main chine body, for example, for contacting the back plate 26 of the paper feed tray 2.

(b) In the third embodiment described hereinbefore, the wheel type contact member 40 acting as the tray positioning mechanism S is rotatable about the axis of rotation A3. The direction of the axis of rotation A3 is not limited to vertical, but may be varied on the conditions of being a direction extending perpendicular to the tray moving direction. The direction may be horizontal or example.

(c) In the third embodiment described hereinbefore, a sheet-like elastic member may be applied to, to extent along, the continuous bent surface defining the plurality of contact surfaces 41 on the wheel type contact member 40. Then, the elastic member acts as the contact portion Sh.

(d) This invention is applicable to paper feeders of various image forming apparatus for such as printers and facsimile machines, besides the paper feeder of the electronic copying machine illustrated in the foregoing embodiments.

What is claimed is:

1. A paper feeder for an image forming apparatus comprising:

a paper feed tray attachable to a tray receiver of a main apparatus body by moving in a tray moving direction perpendicular to a direction of feeding paper loaded in the feed tray; and a tray positioning mechanism for contacting one of said paper feed tray and said main apparatus body as said paper feed tray is attached to said tray receiver, to restrict movement in said tray moving direction of said paper feed tray, said tray positioning mechanism being attached to the other of said paper feed tray and said main apparatus body;

said tray positioning mechanism having a contact portion for contacting one of said paper feed tray and said main apparatus body, a position of said contact portion being adjustable in said tray moving direction;

wherein said tray positioning mechanism includes a fixed member fixed to the other of said paper feed tray and said main apparatus body, and a contact member having said contact portion, said fixed member and said contact member being relatively movably connected to each other, at least one of said fixed member and said contact member having a plurality of reaction force receiving surfaces for receiving a contact reaction force of said tray positioning mechanism, said reaction force receiving surfaces formed continuously and provided in different positions in said tray moving direction, respectively, to allow said fixed member and said contact member to be relatively moved, thereby selecting a desired reaction force surface from said plurality of reaction force receiving surfaces to switch to an operative state to vary and adjust the position in said tray moving direction of said contact portion.

2. A paper feeder for an image forming apparatus as defined in claim 1, wherein:

both of said fixed member and said contact member are formed as cylindrical members and have said reaction force receiving surfaces for contacting each other, respectively, said reaction force receiving surfaces extending stepwise circumferentially of said cylindrical members;

said fixed member and said contact member are connected to each other to be movable relative to each other along said tray moving direction, biased toward each other in said tray moving direction, and rotatable about an axis of rotation extending in said tray moving direction; and the operative state of said stepped reaction force receiving surfaces is changeable by rotating said contact member about said axis of rotation.

3. A paper feeder for an image forming apparatus as defined in claim 1, wherein:

said contact member has a plate portion extending in said tray moving direction;

said plate portion defines bent slits having stepped edges acting as said plurality of reaction force receiving surfaces, and shaped to follow the stepped edges;

bolt objects acting as said fixed member are passed through and engaged with said slits; and said bolt objects are placed in contact with selectively part of steps of said slits by moving said contact member with said slits engaging said bolt objects.

4. A paper feeder for an image forming apparatus comprising:

a paper feed tray attachable to a tray receiver of a main apparatus body by moving in a tray moving direction perpendicular to a direction of feeding paper loaded in the feed tray; and a tray positioning mechanism for contacting one of said paper feed tray and said main apparatus body as said paper feed tray is attached to said tray receiver, to restrict movement in said tray moving direction of said paper feed tray, said tray positioning mechanism being attached to the other of said paper feed tray and said main apparatus body;

said tray positioning mechanism having a contact portion for contacting one of said paper feed tray and said main apparatus body, a position of said contact portion being adjustable in said tray moving direction;

wherein said tray positioning mechanism is attached to one of said paper feed tray and said main apparatus body to be rotatable about an axis of rotation extending perpendicular to said tray moving direction;

said tray positioning mechanism has a continuous bent peripheral surface around said axis of rotation, said peripheral surface defining a plurality of surfaces having different distances from said axis of rotation and arranged in order of their distances, each of said surfaces acts as said contact portion; and the position of said contact portion is adjustable in said tray moving direction by rotating said tray positioning mechanism about said axis of rotation.

* * * * *

UNITED STATES PATENT AND TRADEMARK OFFICE

CERTIFICATE OF CORRECTION

PATENT NO. : 7,404,555 B2
APPLICATION NO. : 11/270315
DATED : July 29, 2008
INVENTOR(S) : Yonemoto It is certified that error appears in the above-identified patent and that said Letters Patent is hereby corrected as shown below:

Face of the Patent, See Item (57) ABSTRACT, last line, "adjust an optical of an image." should read -- adjust an optical axis of an image. --

Signed and Sealed this

Ninth Day of December, 2008

JON W. DUDAS
*Director of the United States Patent and Trademark Office*